United States Patent [19]

Zeller-Pendrey et al.

[11] 4,409,316

[45] Oct. 11, 1983

[54] RESISTIVELY HEATABLE PHOTOTHERMOGRAPHIC ELEMENT WITH STRIPPABLE LAYER

[75] Inventors: Jeanine I. Zeller-Pendrey, Woodbury; Mark C. Skinner, Afton Township, Washington County; David A. Morgan, Lake Elmo, all of Minn.

[73] Assignee: Minnesota Mining and Manufacturing Company, St. Paul, Minn.

[21] Appl. No.: 352,648

[22] Filed: Feb. 26, 1982

[51] Int. Cl.[3] ..... G03C 1/90; G03C 1/84; G03C 1/02

[52] U.S. Cl. ..... 430/263; 430/259; 430/262; 430/353; 430/513; 430/514; 430/515; 430/617; 430/619; 430/151

[58] Field of Search ..... 430/259, 262, 263, 151, 430/162, 353, 336, 617, 619, 620, 513, 514, 515; 219/216

[56] References Cited

U.S. PATENT DOCUMENTS

| | | | |
|---|---|---|---|
| 3,168,402 | 2/1965 | Branibar | 430/263 |
| 3,249,559 | 5/1966 | Gallas | 252/510 |
| 3,307,950 | 3/1967 | Appelbaum | 96/83 |
| 3,619,335 | 11/1971 | Bryan | 161/1 |
| 3,748,137 | 7/1973 | Worth | 430/619 |
| 3,779,771 | 12/1973 | Gatzke | 430/514 |
| 3,881,932 | 5/1975 | Young | 430/220 |
| 3,887,787 | 6/1975 | Gregg | 219/216 |
| 4,120,722 | 10/1978 | Okamoto et al. | 430/619 |
| 4,262,088 | 4/1981 | Vallarino et al. | 430/514 |

FOREIGN PATENT DOCUMENTS

| | | | |
|---|---|---|---|
| 839193 | 4/1970 | Canada | 96/63 |
| 1261102 | 2/1969 | United Kingdom . | |

*Primary Examiner*—Richard L. Schilling
*Attorney, Agent, or Firm*—Donald M. Sell; James A. Smith; Mark A. Litman

[57] ABSTRACT

Photothermographic imaging elements are provided with strippable layers which have electrical conductivity in the range of 60 to 1,500 ohms/square. The elements may be exposed to radiation and then thermally developed by applying a voltage across the strippable layer which becomes resistively heated. After development, the strippable layer may be removed.

8 Claims, No Drawings

RESISTIVELY HEATABLE PHOTOTHERMOGRAPHIC ELEMENT WITH STRIPPABLE LAYER

TECHNICAL FIELD

The present invention relates to photothermographic imaging materials and in particular to such imaging materials which may be heated for development of images by the application of voltage across an electrically resistive layer.

BACKGROUND OF THE ART

Photothermographic imaging systems are those imaging materials which, upon first being exposed to light in an imagewise fashion, produce an image when subsequently heated. The exposure to light or other radiation photoactivates or photodeactivates a component in the imageable element and subsequent heating causes an image forming reaction to differentially occur in exposed and unexposed regions.

A variety of different types of photothermographic technologies exist in the marketplace. Thermal diazonium systems such as those disclosed in U.S. Pat. Nos. 4,230,789; 4,168,171 and 3,754,916 comprise an acid-stabilized light-sensitive diazonium salt, a compound that couples with diazonium salts (known as an azo-coupling compound), and a neutralizing compound which becomes basic, releases a base by decomposition, or is basic and migrates to the acid-stabilized diazonium salt upon being heated. These components are in a binder system coated onto a support base.

Another well known photothermographic imaging system is described in U.S. Pat. Nos. 3,457,075; 3,839,049 and 3,994,732. These imageable systems comprise a silver source material (usually an organic silver salt, a silver salt of an organic long chain fatty carboxylic acid, or a complexed silver salt), silver halide in catalytic proximity to the silver source material, a reducing agent for silver ion, and a binder.

Other photothermographic imaging systems comprising leuco dye oxidation systems and dye-bleach systems such as those described in U.S. Patent Application Serial Nos. (Winslow, Winslow-Gatzke, Gatzke case) are also useful systems.

Each of these systems are used either by first exposing the element to light and then having the entire element heated (e.g., on a heated drum roll, in an inert oil bath, or by exposure to infrared radiation) or by heating and exposing the element contemporaneously. All of these forms of heating tend to be energy inefficient and may cause unequal development of the image because of unequal heating. To overcome some of these difficulties, a few recent products having opaque support layers have been provided with a conductive layer such as vapor deposited metal or carbon black-filled polymeric resin. This conductive layer, or more accurately resistive layer, allows the element to be heated by the application of a voltage across the layer. The voltage must be sufficient to generate heat in the resistive layer. The heat generated can then be sufficient to thermally develop an image on an exposed photothermographic element. The resistive layer is not particularly aesthetically pleasing when viewed from the back and cannot be used with a transparent substrate, particularly when the final image is to be projected, because the resistive layer is often opaque. Furthermore, the resistive layer, if a thin (e.g., vapor deposited) metal layer, is readily subject to damage and discontinuities which would appear as defects in the final image.

SUMMARY OF THE INVENTION

A photothermographic element is made capable of being heated for development after imagewise exposure to radiation by placing a strippable resistive layer having resistivity of between 60 and 1500 ohms/square on the back side of the element. The layer must be strippable as an integral layer by peeling the resistive layer off the photothermographic element.

DETAILED DESCRIPTION OF THE INVENTION

A photothermographically imageable layer or layers is adhered to one side of a support base and a resistive layer having a resistance of between 60 and 1,500 ohms per square is strippably adhered to the other side (hereafter the backside) of the support base. When voltage is applied across the resistive layer (e.g., between 70 and 2,000 volts), sufficient heat can be produced to develop images in the photothermographic portion of the construction. The photothermographic portion of the construction can be any imageable layer or layers which is photosensitive and developable by being heated in the temperature range of 150° to 350° F. (approximately 65°–180° C.). The most common photothermographic systems of this type are (1) silver halide photothermographic systems comprising silver halide, a silver source material, and a reducing agent for silver ion in a binder, (2) thermal diazonium photothermographic systems comprising an acid-stabilized diazonium salt, an azo-coupling compound and a base or base-generating material in a binder, (3) dye-bleach photothermographic systems comprising a photosensitive bleach-producing or bleach-removing material and a dye in a binder, and (4) leuco dye oxidation photothermographic systems comprising a leuco dye oxidizable to a colored state, a photosensitive material which generates an oxidizing agent or a photosensitive oxidizing agent that decomposes when light struck. Other systems such as photosensitive materials which color upon a photoinitiated change in pH or photoinitiated coupling are also known and included in the term photothermographic systems. These systems may be in a single layer or in a plurality of layers as is well known in the art. Most preferred are the silver halide photothermographic systems. The construction of the present invention is also particularly useful with add-on silver halide photothermographic systems which must be heated in order to provide light-sensitivity.

The support base or substrate may be any solid material, such as fibrous material, paper, polymeric film, polymer coated paper, and the like. It is preferred that the support base be a polymeric film and most preferred that it be a transparent polymeric film of such materials as polyester (e.g. polyethyleneterephthalate), cellulose ester (e.g., cellulose acetate, cellulose acetate butyrate, cellulose acetate propionate), polyolefins, polyvinyl resins and the like.

The resistive layer having a resistance between 60 and 1,500 ohms per square can be any material which provides that physical property. One can use insulative material which is filled with a sufficient amount of conductive particles, flakes or fibers to provide the required resistance, one can use a conductive material filled with insulative particles, flakes or fibers, or one can select a material naturally having the required resistivity.

The preferred resistive layers of the present invention comprise polymeric resin filled with conductive material. For example, filler such as carbon black, graphite, metal, conductive polymers (e.g., polymers having quaternary ammonium groups thereon) and other generally available materials may be used. The binder or resin of the resistive layer may be any material which provides the physical properties necessary. Such resins as polyesters, polyamides, polyolefins, polyvinyls, polyethers, polycarbonates, gelatin, cellulose esters, polyvinyl acetals and the like are all useful.

The resistive layer must be strippably bonded to the backside of the support base. This can be readily accomplished by a variety of means. For example, the resistive layer may be coated out of solution on to the support base with appropriate resins having been selected for the base and the resistive layer which have only a limited natural affinity for each other. To that end, combinations of polyethyleneterephthalate and cellulose esters, polyesters and polyamides, and polyamides and polyvinyl acetals would provide only limited strength bonding between layers so that the resistive layer could be stripped from the backside of the support base.

An intermediate layer could also be used which is readily strippable from the support base. If the resisitive layer is sufficiently thick and strong so as to provide structural integrity, a pressure sensitive adhesive layer could be used to strippably adhere the resistive layer to the backside of the support base. The resistive layer could be adhered to one side of a carrier layer which is adhered to the backside of the support base. The resistive layer could be adhered to one side of a carrier layer which is adhered to the backside of the support base. In fact, a conductive pressure sensitive adhesive carried on a support film could be used as the resistive layer.

When the terms 'strippably adhered' or 'strippably bonded' are used, it is meant and well understood in the art that the layers are sufficiently well adhered to each other to undergo mild handling without the layers completely separating and yet be separable from each other by hand when required. This generally means that a force of about 0.5 to 9 ounces per inch width (36 to 650 g/cm width) of film is needed to separate the two layers when one film is pulled at 180° from the other at about ninety (90) inches (229 cm) per minute. Preferably this peel force is in the range of 1 to 6 ounces per inch width (72 to 433 g/cm width).

The resisitive layer and/or the intermediate layer providing the strippable properties can also provide another function to the element. One problem often encountered with imaging materials is the phenomenon of halation caused by reflection of radiation off the backside of the support layer. If the strippable layer or resistive layer absorbs radiation to which the photothermographic material is sensitive, those layers can act as antihalation layers. Carbon black, in particular, is a good filler for providing panchromatic antihalation properties to the element. Dyes and pigments which absorb within specific regions of the electromagnetic spectum can also be used. The antihalation property is not essential but is desirable. Thus the resistive layer and/or strippable layer can be transparent, translucent, or opaque. A white background (e.g., by using titania or zinc oxide as a filler) can even be provided.

Even though the construction of the present invention can be heated by application of a voltage across the resistive layer, the exposed element can still be developed by any other form of heating.

These and other aspects of the present invention can be seen in the following examples. All proportions are by weight unless otherwise stated.

EXAMPLE 1

A photothermographic element was constructed comprising a support base of 4 mil ($1.02\times10^{-4}$ m) polyethylene terephthalate filler base coated with a first layer comprising 12.5 parts silver behenate, 375 parts of polyvinyl butyral, 46 parts 1-methyl-2-pyrrolidinone, 0.25 parts HBr and 0.10 parts HI, 0.20 parts $HgBr_2$, 0.08 parts of a merocyanine spectral sensitizing dye (Lith 454 dye disclosed in U.S. Pat. No. 4,260,677), 40 parts 1,1-bis(2-hydroxy-3,5-dimethylphenyl-3,5,5-trimethylhexane and 10 parts of phthalazinone in a solvent solution of 6.5 parts methyl isobutyl ketone, 21 parts toluene and 60 parts methyl ethyl ketone. The solution was coated at 100 microns wet thickness and dried in a forced air draft at 85° C. for four minutes. A protective top coat of a polyvinyl acetate/polyvinyl chloride copolymer (80/20) in methyl ethyl ketone was coated at 65 microns wet thickness and similarly dried.

To the backside of the support base was coated a release coating of eighty-five percent cellulose acetate and fifteen percent cellulose acetate propionate in methyl ethyl ketone. After drying at room temperature, a second coating comprising polyvinyl butyral in an ethanol/toluene solvent solution with 25 weight percent carbon black was coated over the release coating and dried at 65° C. for five minutes. The release coating was at 1.35 g/ft$^2$ (10.2 g/m$^2$) and the resistive coating was at 0.85 g/ft$^2$ (6.4 g/m$^2$).

The completed photothermographic element was exposed through a 0–4 step wedge to a carbon arc light source. A voltage of 535 volts was applied across the resistive layer for 4–5 seconds. Sufficient heat was generated to develop the silver image to a Dmax of 2.3 and a Dmin of 0.15. The conductive layer and strippable layer were then easily peeled from the backside of the element.

The above construction was duplicated except that the carbon black was added to the strippable layer and no second coating was applied to the backside of the support base. After exposure and development the one piece strippable conductive layer was easily peeled from the support base.

We claim:

1. A photothermographic element comprising a support base having on one surface thereof a photothermographically imageable layer and adhered to the opposite surface of said support base a strippable layer having a resistance of between 60 and 1,500 ohms per square.

2. The element of claim 1 wherein said strippable layer comprises a first insulating layer having one side bonded to said opposite surface of said support base and a second layer which provides the resistnce of between 60 and 1500 ohms per square adhered to the other side of said first layer.

3. The element of claim 1 wherein said strippable layer comprises a polymeric resin filled with conductive material and said strippable layer may be removed by a force of 0.5 to 9 ounces per inch width of the layer.

4. The element of claim 3 wherein said conductive material is selected from the group consisting of carbon black, graphite, and metal.

5. The element of claim 3 wherein said conductive material comprises carbon black.

6. The element of claims 1, 2, or 5 wherein said photothermographic layer comprises silver halide, a silver source material and a reducing agent for silver ion in a polymeric binder.

7. The element of claims 1, 2 or 5 wherein said support base is a transparent polyethylene terephthalate polymeric resin layer and said strippable layer comprises a mixture of cellulose acetate and cellulose acetate propionate.

8. The element of claims 1, 2 or 5 wherein said photothermographic layer comprises silver halide, a silver source material, and a reducing agent for silver ion and said support base comprises a transparent polyethylene terephthalate polymeric resin and said strippable layer comprises a cellulose ester.

* * * * *